United States Patent [19]

Kuehnle

[11] 4,255,508

[45] * Mar. 10, 1981

[54] FLEXIBLE METAL PRINTING CYLINDER HAVING A COATING OF CRYSTALLINE PHOTOCONDUCTIVE MATERIAL

[75] Inventor: Manfred R. Kuehnle, Lexington, Mass.

[73] Assignee: Coulter Systems Corporation, Bedford, Mass.

[ * ] Notice: The portion of the term of this patent subsequent to May 24, 1994, has been disclaimed.

[21] Appl. No.: 864,377

[22] Filed: Dec. 27, 1977

[51] Int. Cl.[3] ..... G03G 5/082; G03G 13/28

[52] U.S. Cl. ..... 430/94; 430/63; 430/84; 204/192 P; 101/DIG. 13; 355/3 DR

[58] Field of Search ..... 204/192 P, 192 S; 96/1.5; 428/539; 355/3 DR; 101/DIG. 13, DIG. 15; 430/63, 84, 94

[56] References Cited

U.S. PATENT DOCUMENTS

| | | | |
|---|---|---|---|
| 3,819,370 | 6/1974 | Komiya et al. | 96/1.5 |
| 3,849,128 | 11/1974 | Ihara | 96/1.5 |
| 4,019,902 | 4/1977 | Leder et al. | 96/1.5 |
| 4,025,339 | 5/1977 | Kuehnle | 204/192 P |

OTHER PUBLICATIONS

Japanese Journal of Applied Physics, vol. 9, #9, Tanaka pp. 1070-1077.

Journal of Vacuum Science and Technology, vol. 7 #2, Lagnado r.f. Sputtered Cadmium Sulfide, pp. 318-321.

*Primary Examiner*—Dennis E. Talbert, Jr.
*Assistant Examiner*—John L. Goodrow
*Attorney, Agent, or Firm*—Silverman, Cass & Singer, Ltd.

[57] ABSTRACT

A flexible metal printing cylinder having a coating of a crystalline photoconductive material thereon. The cylinder is an electrodeposited sleeve of nickel or similar material that is a fraction of a millimeter in thickness which is adapted to be mounted in a printing press in order to enable the press to print electrostatically. The coating is applied by r.f. sputtering and comprises a thin film layer of the order of about 2000 to 6000 Angstroms thick of a wholly inorganic, electronically anisotropic, crystalline, flexible, high gain photoconductive material, as for example ultrapure cadmium sulfide. The cylinder may have an image adhered to its surface which is of dry insulating toner.

10 Claims, 3 Drawing Figures

FLEXIBLE METAL PRINTING CYLINDER HAVING A COATING OF CRYSTALLINE PHOTOCONDUCTIVE MATERIAL

FIELD AND BACKGROUND OF THE INVENTION

The field of this invention comprises cylinders for printing presses and more particularly is concerned with the type of cylinders which would be used in a color-printing press that utilizes multiple cylinders, each required to provide a color component of a color image to a substrate.

Color printing as practiced heretofore is a well-known technology. Basically, a colored subject is photographed through separate filters to achieve so-called color separation negatives. These negatives are used to make half-tone plates to print the most common type of color printing utilizing black, yellow, cyan and magenta imprints to synthesize the color and texture of the original subject. The plates are mounted in letterpress or gravure machines and the substrate upon which the final imprint is to appear is run through the press with the plates all carefully synchronized to achieve perfect registration. Inks are chosen to achieve the desired results, these being applied to the plates and transferred from the plates directly or indirectly to the substrate.

Small runs of color prints or color printing effected with simple equipment can be done by printing sheets repeatedly with the different plates and inks in separate operations to achieve the desired results.

In recent years electrostatic imaging has replaced much of what was formerly done by photocopying of the so-calledphotostat type. By electrostatic imaging it is meant that the imaging is done by xerographic or electrofax techniques. In these techniques an electrophotographic member such as a sheet or drum having a coating of photoconductive material is charged by high voltage corona in darkness, the coating is exposed to a projected image of the subject matter selectively to discharge the same and produce a latent charge image which is a reproduction of the projected image and is then developed by toning.

In toning, fine particles of resin or other material is applied to the latent image surface. These fine particles are called toner in the art and are made up of different kinds of pigment, carbon, resin, dyes, etc. Toner is known in both liquid and powder form. In either case the particles are charged by triboelectric or electropheretic techniques to be charged to a polarity which will cause the particles to adhere to the photoconductive coating in accordance with the latent image. The latent image thus becomes visible.

In the case of xerography, where the electrophotographic member is for example a metal drum having a coating of amorphous selenium, the drum is pressed against a substrate such as paper and, in the presence of an electrical field is transferred to the paper after which it is fused to the paper by heat. In the case of electrofax, where the electrophotographic member is for example a sheet of conductive paper having a coating of zinc oxide particles in an inorganic matrix, the sheet itself is the finished article. The toner is fused to the sheet.

The principal kind of printing done by these techniques has been in single copies of some projected image. In the case of the xerographic apparatus, there is a new exposure and cycle for each copy. In the case of the electrofax there is also a new exposure and cycle for each copy but in this instance the electrophotographic member is not re-used but is removed from the apparatus as the copy.

The electrofax type of electrophotographic member has been used by suitable processing to form temporary printing plates by making the image and its background ink-differentiating. One is rendered hydrophobic and the other hydrophyllic by the process and in this condition the member is mounted in a printing press and used to make copies by treating it as a printing plate. Quality is low and the number of copies capable of being made from a single plate is substantially less than several thousand. Some attempts have been made by this method to achieve electrostatic color printing, but so far as known, there has been no success with this process because of many disadvantages, especially because zinc oxide plates are not panchromatic.

In U.S. Pat. No. 4,025,339 there is described a type of electrophotographic member and coating which is unique in its composition and properties. The coating is a sputtered coating of wholly inorganic material, for example, cadmium sulfide, deposited under certain condition in an r.f. sputtering chamber upon its substrate in a thickness of the order of 3000 to 6000 Angstroms. The coating displays high gain, electronic anisotropy, can be charged and discharged at high speed, has resolution easily attaining1000 line pairs per millimeter, is transparent, has a hard, crystalline structure with the crystals oriented vertically, has a dark resistivity of at least $10^{12}$ ohm centimeters and a ratio between dark and light resistivity of at least $10^4$.

This electrophotographic member is described as deposited onto a substrate of polyester having a thickness which is a fraction of a millimeter with an intervening bonded layer of some ohmic material such as indium-tin oxide of a thickness which is of the order of 200 Angstroms. This electrophotographic member can be used to make transparencies and has properties which enable it to perform as well as many types of silver film and better than most. It is highly flexible, being readily rolled around a rod less than a centimeter in diameter without damaging the coating. The coating is archival in quality since it is not adversely affected by heat, light, moisure or fungus.

The invention herein contemplates a novel use for the coating which, as explained in said U.S. Pat. No. 4,025,339, readily bonds to metal surfaces. The novel use is in making a printing plate, especially for use in color printing presses.

In U.S. Pat. Nos. 2,287,122 and 3,354,519 a type of printing cylinder is described which comprises an electrodeposited or electroformed sleeve of nickel that is a small fraction of a millimeter in thickness. The cylinders of this construction which are known are about a fifth of a meter in diameter and several meters long. Up to the present time these cylinders were used in a manner which required their manufacture with fine perforations. These perforations were made with patterns or images to provide for the expression of ink through the cylinder from the interior thereof by doctor means onto the substrate over which the cylinder rolled. Overall uniform perforations were applied in some cases and the patterns or images produced by blocking some of the perforations selectively.

The advantages of these cylinders are explained in the said U.S. Pat. Nos. 2,287,122 and 3,354,519, but basically they are economical, light in weight, easily transported, easily handled and mounted.

Problems arise in connection with these cylinders for use with electrostatic printing techniques which, it is believed, would direct one skilled in the printing art to avoid such use. These problems include the need for perforations and expressing inks through the cylinders from the interior thereof; the difficulties of causing known photoconductors to adhere to the cylinders and not craze, flake off, break or wear out; the need for applying excessively thick coatings to achieve reasonable imaging properties whereby the advantages of the thin walls and flexibility of the cylinders are obviated.

The invention herein resolves around a marriage of the thin-walled electrodeposited cylinder and the extremely thin and flexible coating of the U.S. Pat. No. 4,025,339 to achieve never before attained advantages in a printing cylinder.

SUMMARY OF THE INVENTION

A printing cylinder comprising an electrodeposited, seamless sleeve of nickel or the like durable metal having a thin wall that is flexible and imperforate and provided with a surface coating of a photoconductive material that is a thin film of a wholly inorganic, flexible, crystalline, high gain, chargeable material that can be readily charged, toned, developed and used to transfer ink without deterioration over a long period of use. An image of insulating toner material may be affixed to the surface of the coating by charging, toning and fusing. This image can then be charged, toned and the toner transferred to a receptor.

DESCRIPTION OF THE PREFERRED EMBODIMENT

As explained hereinabove, the invention herein is directed to a printing cylinder that can be used for color printing in a printing press by electrostatic techniques. It should be understood that the printing cylinder of the invention is also applicable for use in black and white printing as well, but the advantages principally derive in its use in a press that is required to make multiple impressions on the same substrate.

Reference to the expression "printing press" is not intended to signify the kind of press which is known by that designation, but is only to enable an understanding of the function of the cylinder. As a matter of fact, it is not expected that there will be direct pressure or contact between the printing cylinder of the invention and the substrate but that the ink or dye or pigment will be transferred electrostatically across a very narrow gap. This is expected to prolong the life of the cylinder.

Figure 1:
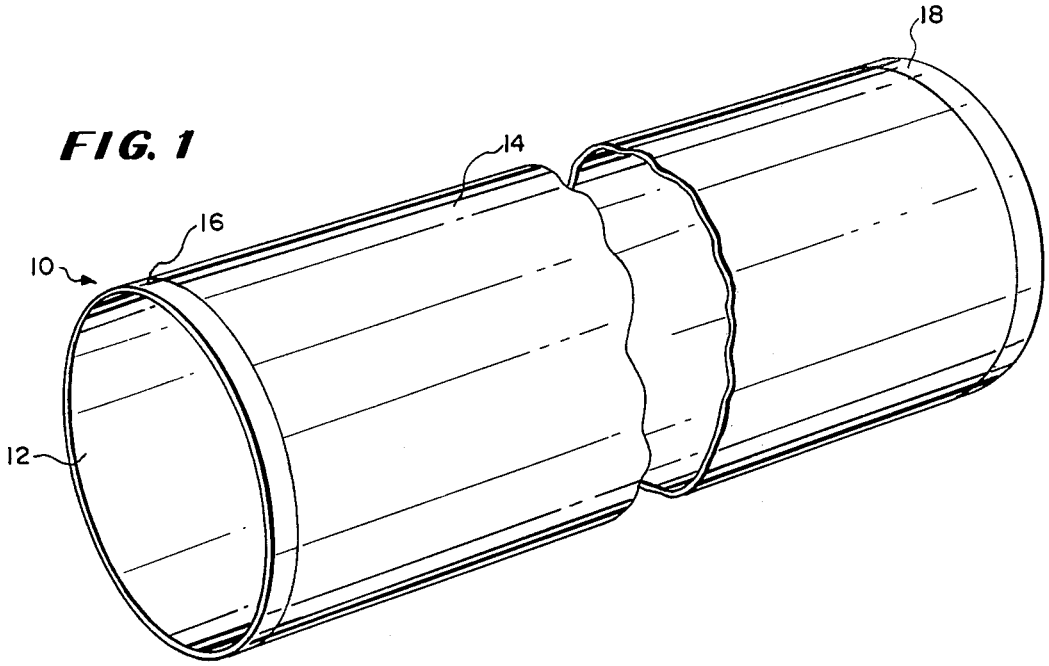
FIG. 1 is a fragmentary perspective view of a printing cylinder constructed in accordance with the invention.
Figure 2:
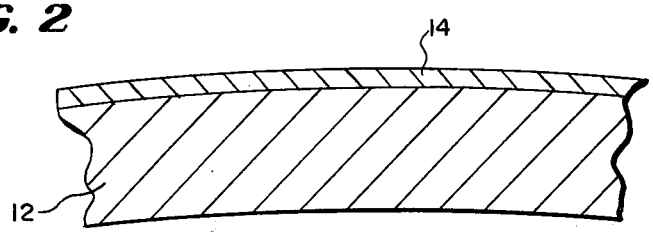
FIG. 2 is a fragmentary sectional view through the wall of said cylinder showing the coating thereof.

In FIG. 1 there is illustrated a cylinder 10 constructed in accordance with the invention. The base or substrate of the cylinder is a sleeve 12 of nickel, copper-plated nickel, copper or similar metal. Nickel is preferred as a base because it is tough, thermally stable and can be electroformed with ease in a highly uniform thickness.

The cylindrical sleeve 12 is seamless and is normally made according to the techniques which are well-known. An early disclosure of these methods is found in U.S. Pat. No. 2,287,122. In the form which is intended for use in accordance with the invention, the wall thickness of the sleeve is about 0.15 millimeter, the circumference is about a meter and the length is about two meters or more.

The cylindrical sleeve 12 is placed in a suitable sputtering apparatus and supported to present a smooth and uninterrupted surface to the target or targets of the sputtering apparatus as it passes the target means during the sputtering operation so that when the process is completed, there is a thin film uniform coating 14 of the deposited photoconductive material on the sleeve.

The thickness of the photoconductive coating 14, which preferably is ultrapure cadmium sulfide, is of the order of 3000 to 6000 Angstroms. Somewhat thicker coatings are feasible because there is no requirement for transparency. There may be dopants in the coating for the purpose of selectively adjusting the spectral response of the coating to different color light.

In the sputtering process the sleeve 12 will be maintained in a condition of relative rigidity by any suitable means as for example a mandrel and clamps in which case the ends of the resulting cylinder 10 may not be coated in annular areas such as indicated at 16 and 18 where the clamps covered the surface.

The electroplated sleeves 12 are highly flexible and collapsible. They can be squeezed down to be fitted in very small containers. For example, a cylindrical container of the same diameter as a single sleeve may have many other sleeves collapsed in reentrant cross section configurations to fit in the center. So long as there are no creases or folds in the collapsed sleeves there will be no damage to them.

Thick coatings of zinc oxide in a matrix of organic material or amorphous selenium are required to provide the performance of these photoconductive materials. At that their characteristics cannot approach those of the coatings of said U.S. Pat. No. 4,025,339. Such coatings would not be capable of being carried on the sleeve 12 without completely changing the weight, flexibility, and handling capabilities of these sleeves. The coatings would not adhere and would crack and flake off if the resulting cylinders were flexed.

The coating of U.S. Pat. No. 4,025,339 is so thin that it has little or no effect upon the physical properties of the sleeve 12. It is about 300 times thinner than the metal wall; hence it does not disturb the flexibility, adds practically no weight and requires no special care in handling.

The thickness of the coating 14 is preferred to be of the order of 3000 to 6000 Angstroms, but since transparency of the coating is only of consequence in being certain that photons will penetrate far enough to be absorbed, the thickness in these printing cylinders can be greater than 6000 Angstroms. It can for example approach one micron or more.

In use, the cylinder 10 will be supported to be perfectly rigid and in cylindrical configuration. Thus it acts as a roller in the printing press, for example, facing a back-up drum around which a continuous elongate substrate passes. The ink or dye is transferred from the roller to the substrate.

The cylinder 10 will be imaged before it is installed in the printing press. Thus, it will have been charged in darkness, exposed to a pattern or image and then toned.

The exposure will be of a pattern that provides a type of image on the cylinder that has dots or small geometric formations to provide the effect that may be called "half-tone" while not actually following the conventional half-tone form. It could be a synthesized image derived from a programmed computer operating through a laser or a reproduction of a photograph or document scanned by a laser or other light source and converted into dots or other shapes of various congurations and geometrical aspects. Laser imaging is feasible because the coating 14 is capable of being imaged at high speed.

Figure 3:
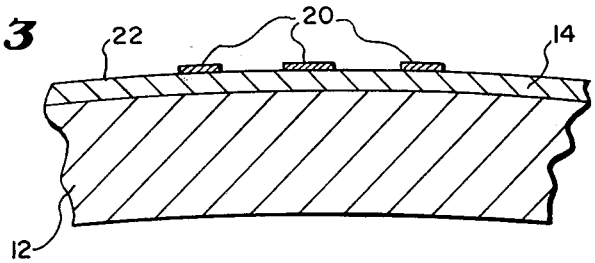
FIG. 3 is a view similar to that of FIG. 2 but showing a toned image adhered to the coating of the cylinder.

When the cylinder 10 has been imaged and toned, the toner pattern is fused in place as shown at 20 in FIG. 3, thereby forming a fixed toned image on the surface of the coating 14. This toner is required to be insulating in nature, called a "dielectric" toner so that it will not participate in the discharge of the untoned portions 22 of the surface.

The cylinder with its toned pattern 14 is now installed on the press. In the course of its use along with other similar cylinders, it will be charged first thus applying a high charge to the surface of the toned image 20. This image is not responsive to light; hence when the remainder of the surface is exposed to bright light or is simply permitted to be exposed to ambient light in use, any charge which was applied by the charging corona to the untoned increments 22 of the cylinder will immediately be dissipated. In this condition the cylinder 10 is rolled through an ink bath which carried what may be termed a secondary toner. This toner will have the desired dye or pigment included in it, the first or primary toner not being required to have any pigment at all.

The pigment adheres only to the charged parts of the cylinder and hence only to the toned image 20. The cylinder rotates past the fountain where it picked up the pigment and thereafter moves to be juxtaposed relative to the substrate to which it transfers its pigment. A bias voltage effects electrostatic transfer so that no physical engagement is necessary. After transfer, the cycle is repeated. Cleaning after transfer will not normally be necessary, but could be provided for.

Several of these cylinders or rollers are disposed around a drum which forms the guide and base for the substrate and against which the printing is effected so that each cylinder applies its own image and color to the substrate. Obviously the synchronization of the cylinders and the registration of the seriatim-applied images must be maintained to achieve perfect color reproduction.

The manufacturer of the cylinders may provide these cylinders 10 to a printing establishment having a suitable printing press in either of two forms. He may furnish the cylinders in blank whereby the printer will have to image his own cylinders or he may provide the cylinders to the printer already imaged with the primary toner. In the latter case the printer will provide the specifications and originals to be imaged.

It is feasible to provide equipment to image the cylinders while in place on the press, but it is believed that for the most part imaging with the primary toner will be done off line.

Other methods of using the described cylinders are contemplated.

Variations are capable of being made without departing from the spirit or scope of the invention as defined in the appended claims.

What it is desired to secure by Letters Patent of the United States is:

1. A printing cylinder which comprises a thin-walled metal sleeve having a thickness of the order of a fraction of a millimeter and being flexible but capable of being rigidly maintained in cylindrical configuration for printing and having a thin film photoconductive coating bonded thereto, the coating being flexible, microcrystalline, wholly inorganic, having a dark resistivity of at least $10^{12}$ ohm centimeters and a ratio of dark to light resistivity of at least $10^4$, having a thickness which is at most of the order of a micron, being electrically anisotropic and being capable of being charged and retaining the charge sufficiently to enable imaging at high speed.

2. A printing cylinder as claimed in claim 1 in which the coating is ultrapure cadmium sulfide.

3. A printing cylinder as claimed in claim 1 in which the sleeve comprises electroformed nickel.

4. A printing cylinder as claimed in claim 1 in which the coating is ultrapure, microcrystalline cadmium sulfide and the sleeve comprises electroformed nickel.

5. A printing cylinder as claimed in claim 1 in which said cylinder has a fused image on the surface of the coating which is formed of insulating toner.

6. A cylinder adapted to be used in printing apparatus for transferring images in accordance with electrostatic techniques which comprises:

A. a thin-walled, metal, seamless sleeve that is of sufficient flexibility to enable easy flexing out of its cylindrical configuration but is readily supported in rigid cylindrical configuration and B. a coating bonded to said sleeve and consisting of a thin film layer of a wholly inorganic, photoconductive material that is microcrystalline with the crystals oriented generally vertically relative to the surface of the sleeve, said coating being capable of accepting a charge and retaining the same sufficiently long enough to enable imaging and development of the image, the coating surface being electrically anisotropic and having a dark resistivity which is at least $10^{12}$ ohm centimeters and a ratio of dark to light resistivity of the order of $10^4$, the flexibility of the sleeve being substantially unimpaired by said coating.

7. The printing cylinder as claimed in claim 6 in which the thickness of the sleeve wall is of the order of a small fraction of a millimeter and the thickness of the coating is at most of the order of a micron.

8. The printing cylinder as claimed in claim 6 in which the coating is a layer of ultrapure cadmium sulfide.

9. The printing cylinder as claimed in claim 6 in which the coating is a layer of ultrapure cadmium sulfide of the order of thickness of at most a micron.

10. The printing cylinder as claimed in claim 6 in which there is a developed toner image of insulating material adhered to the surface of said coating.

* * * * *